US005322391A

United States Patent [19]

Fisk

[11] Patent Number: 5,322,391

[45] Date of Patent: Jun. 21, 1994

[54] GUIDED MOLE

[75] Inventor: Allan T. Fisk, Needham, Mass.

[73] Assignee: Foster-Miller, Inc., Waltham, Mass.

[21] Appl. No.: 938,819

[22] Filed: Sep. 1, 1992

[51] Int. Cl.[5] ..... E21B 7/04

[52] U.S. Cl. ..... 175/73; 175/19; 175/45; 175/61; 405/138; 405/154; 405/184

[58] Field of Search ..... 405/154, 184, 232, 138; 175/45, 53, 61, 62, 73-76

[56] References Cited

U.S. PATENT DOCUMENTS

| | | | |
|---|---|---|---|
| 2,075,064 | 3/1937 | Schumacher et al. . | |
| 2,153,680 | 4/1939 | Schumacher et al. . | |
| 2,196,940 | 4/1940 | Potts . | |
| 2,324,102 | 7/1943 | Miller et al. . | |
| 2,350,986 | 6/1944 | Collins . | |
| 2,686,660 | 8/1954 | Storm . | |
| 2,873,092 | 2/1959 | Dwyer . | |
| 2,903,239 | 9/1959 | Standridge . | |
| 3,211,244 | 10/1965 | Cordary . | |
| 3,419,091 | 12/1968 | Gardner . | |
| 3,467,211 | 9/1969 | Goodwin et al. . | |
| 3,712,391 | 1/1973 | Coyne . | |
| 3,878,903 | 4/1975 | Cherrington . | |
| 4,396,073 | 8/1983 | Reichman et al. . | |
| 4,679,637 | 7/1987 | Cherrington et al. . | |
| 4,714,118 | 12/1987 | Baker et al. . | |
| 4,787,463 | 11/1988 | Geller et al. . | |
| 4,834,193 | 5/1989 | Leitko et al. | 175/73 X |
| 4,858,704 | 8/1989 | McDonald et al. . | |
| 4,867,255 | 9/1989 | Baker et al. . | |
| 4,921,055 | 5/1990 | Kayes . | |
| 4,993,503 | 2/1991 | Fischer et al. . | |
| 5,002,137 | 3/1991 | Dickinson et al. | 175/73 X |
| 5,163,520 | 11/1992 | Gibson et al. | 175/45 X |
| 5,255,749 | 10/1993 | Bumpurs et al. | 175/73 X |

FOREIGN PATENT DOCUMENTS

| | | |
|---|---|---|
| 2126267 | 3/1984 | United Kingdom . |

*Primary Examiner*—Dennis L. Taylor
*Attorney, Agent, or Firm*—Fish & Richardson

[57] ABSTRACT

Boring apparatus for forming a generally horizontal underground passage in soil for a utility conduit or the like that includes a tool head with a base portion and a nose portion mounted on the base portion. The nose portion is rotatable relative to the base portion between a first position in which nose portion surfaces are symmetrical with respect to the tool axis so that the tool will move along a straight path and a second position in which nose portion surfaces are in asymmetrical position with respect to the tool axis so that said tool will move along a curved path. By application of torque to the base portion, the base portion is shifted relative to the nose portion to shift the tool head from between an asymmetrical configuration and a symmetrical configuration.

20 Claims, 3 Drawing Sheets

GUIDED MOLE

This invention relates to methods and apparatus for boring underground horizontal passageways.

Horizontally bored underground passageways for pipelines and utilities such as electrical distribution lines provide a safe, economical and environmentally responsible alternative to digging through or building over natural terrain and man-made obstacles.

A wide variety of drilling methods and apparatus for boring underground passageways for installation of utility cables, pipes and the like are known. Those known techniques include the use of a pneumatic impact piercing tool (sometimes termed a "mole") to punch a hole through soil (not rock) without the need to excavate an open trench in which to lay the pipe or cable. The accuracy of such moles is poor for all but short straight line distances. Unguided moles are easily deflected off course by common anomalies, such as rocks, found in the soil. A trackable transmitter, or sonde, may be mounted on the mole to provide information on its course. A particular impact mole system includes an impact mole mounted on the end of a rigid drill pipe which is used to feed air to the impact mole. Housed within the mole is a shock resistant sonde which delivers location, depth and roll angle information to an operator on the surface. The front end of that mole has a forwardly facing slant face which tends to cause the tool to deflect from a straight path as it advances forward. The rigid drill pipe is used to rotate the entire drill string and the mole as it is thrust forward, and as long as rotation is maintained, the deflecting action of the slant face is "averaged out" and the tool advances in a nominally straight (slightly spiral) path unless deflected off course by an obstacle. When it is desired to direct the mole in a desired direction, the rigid drill pipe is rotated to bring the slant face to the desired roll orientation, utilizing data from the sonde. The tool is then thrust forward without rotation such that the tool is deflected by action of the nonrotating slant face on the soil. Significant torque is required to turn the drill string in the soil when advancing along a relatively straight path, the hydraulic power used for rotation and thrust being in addition to the pneumatic power required by the impactor in the mole.

In accordance with one aspect of the invention, there is provided moling apparatus for forming a generally horizontal underground passage in soil for a utility conduit or the like that includes tool head structure with a base portion and a nose portion mounted on the base portion. The nose portion is rotatable relative to the base portion between a first position in which nose portion surfaces are symmetrical with respect to the tool axis so that the tool will move along a straight path and a second position in which nose portion surfaces are in asymmetrical position with respect to the tool axis so that the tool will move along a curved path. Preferably, the nose portion remains rotationally fixed relative to the soil and by application of torque to the base portion, the base portion is rotated about the tool axis relative to the nose portion to shift the tool head between the asymmetrical configuration and the symmetrical configuration.

In accordance with another aspect of the invention, there is provided moling apparatus for forming a generally horizontal underground passage in soil for a utility conduit or the like that includes tool head structure that defines a tool axis and includes a base portion and a nose portion mounted on the base portion. Impact structure applies a series of percussive impacts to the tool head structure for driving the tool head structure through the earth by displacing soil without necessity of soil removal. The apparatus also includes structure for applying torsional force to the base portion to rotate the base portion about the tool axis relative to the nose portion selectively to shift the nose portion between first and second positions. In the first nose portion position, the nose portion has surfaces which are in symmetrical position with respect to the tool axis so that the tool will move through the soil along a straight path; and in the second nose portion position, the nose surfaces are in asymmetrical position with respect to the tool axis so that the tool will move through the soil along a curved path in response to impact forces generated by the impact structure.

In preferred embodiments, the torsional force applying structure includes elongated torsionally stiff structure that is connected to the tool head structure and that extends to the surface of the soil in which the passage is to be formed. Sonde structure is in the tool head structure for supplying positional information to a point above the surface of the soil in which said passage is to be formed.

In a particular embodiment, the impact structure is pneumatically actuated; the torsionally stiff structure is an air hose for supplying pressurized air to the impact structure; and operator controllable torque generating structure applies torsional force to the air hose at the surface of the soil in which the passage is to be formed.

In one embodiment, the nose portion is mounted on the base portion for rotation about a swash axis that is at an angle to the tool axis; in another embodiment, the nose portion is a sleeve member with a cylindrical inner surface, the base portion is a core member with a cylindrical outer surface and is disposed within the sleeve member, and the sleeve and core members have slant face portions that are in offset orientation in the first position and in aligned relation in the second position; and in a third embodiment, the nose portion is mounted on the base portion for rotation about an axis that is parallel to and offset from the tool axis.

Other features and advantages of the invention will be seen as the following description of particular embodiments progresses, in conjunction with the drawings, in which.

DESCRIPTION OF PARTICULAR EMBODIMENTS

Figure 1:
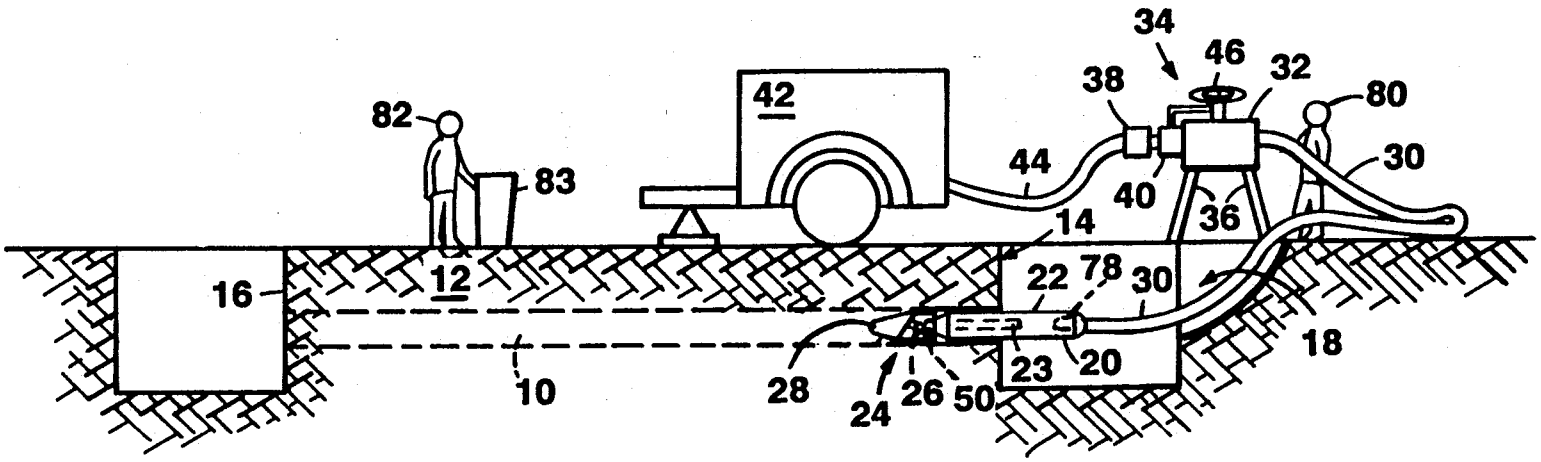
FIG. 1 is a diagrammatic view of horizontal boring apparatus according to the invention.
Figure 2:
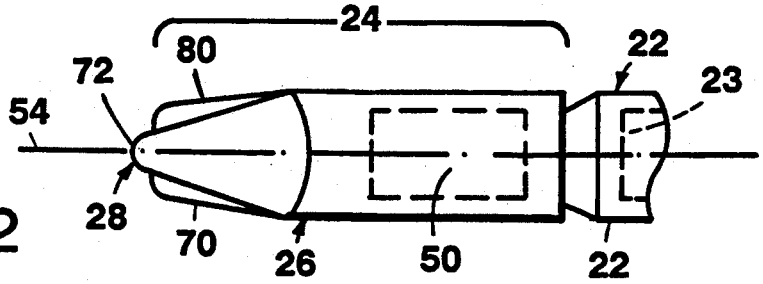
FIG. 2 is a top view of the boring head of the apparatus shown FIG. 1.
Figure 3:
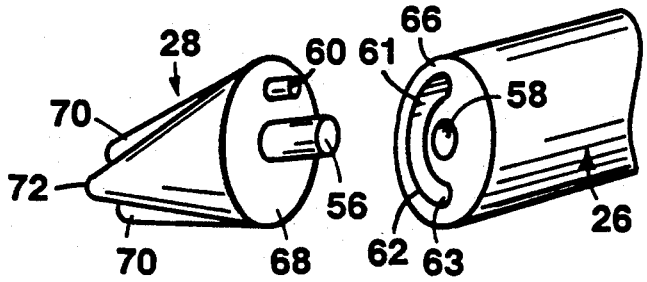
FIG. 3 is an exploded perspective view of the boring head of FIG. 2.
Figure 4:
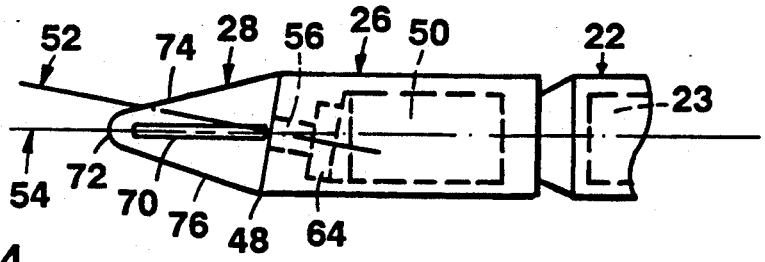
FIG. 4 is a side view of the boring head of FIG. 2 in a first position.

The schematic diagram of FIG. 1 shows a system for boring underground passageway 10 through strata 12 that may be relatively unconsolidated soil such as gravel for an electrical cable interconnection disposed between launch pit 14 and target pit 16. The system includes mole 20 with body portion 22 that includes a percussive (impact) mechanism 23 and head portion 24 that includes base 26 and nose section 28. In an alternative arrangement, the mole can be "surface launched" as is common practice with directional drills and some rod pushers In the "surface launched" mode, the mole 20 follows a curved path from the surface to the launch pit 14 where there is opportunity to realign the 20 mole in the intended direction of the bore 10. The "surface launched" mole minimizes the size of launch pit 14 since no slot 18 is required to accommodate air hose 30.

Coupled to air hose 30 is torque controller 32 which includes rotary actuator 34 connected to the torsionally stiff air hose 30 which feeds mole 20. Hose 30 follows mole 20 into bore passage 10 and thus must be at least slightly longer than the length of the intended bore passage 10. Torque controller 32 may be located near the launch point so that it need not be moved as mole 20 advances into bore passage 10. Preferably, some provision such as a ground spike or spreader legs 36, are provided to compensate for hose torque generated by rotary actuator 34. Hose swivel 38 is provided between the inlet 40 of controller 32 and air compressor 42 so that the air supply hose 44 from the air compressor may simply lie on the ground and need not rotate when air hose 30 during moling operation.

Torque controller 32 includes control valving diagrammatically indicated at 46 so that the operator 80 may select clockwise or counterclockwise hose torque, rotational speed, and torque values for best operation in varying conditions, and draws its pneumatic power from the same air supply 42 as the air feeding mole 20 through hose 30. Other convenient means may be provided to control application of torque to the mole air hose 30 such as a hose torquing device located near the launch point, air hose 30 passing through the torquing device which grips the exterior of the air hose and applies the desired torque and is mounted for reciprocating movement in a slot to accommodate advancement of mole 20 and its air hose 30.

With reference to FIGS. 2–5, mole head 24 includes base portion 26 in which directional sonde 50 is mounted and nose portion 28 which is rotatably mounted on base portion 26. The interface between the nose and base sections (surface 68 of nose 28 and surface 66 of base 26) forms a swash plane 48 that defines a swash axis 52 disposed at an angle of 15° to the axis 54 of base portion 26. Nose portion 28 is retained to base 26 by shank 56 (FIG. 4) which engages bore 58 in base 26. Limit pin 60 is engaged in arcuate slot 62. The ends 61, 63 of slot 62 provide rotational stops that limit the rotational movement of base 26 relative to nose 28 relative to nose 28. Rotation of nose portion 28 relative to base portion 26 takes place about swash axis 52, which as drawn is coincident with the axes of shank 56 and bore 58.

A suitable fastener 64 such as a nut or retaining ring structure secures the tool portions together in mating relation. The slot or guideway 62 limits rotation of nose piece 28 between a first (straight ahead) position shown in FIG. 4 and a second (curved moling) position shown in FIG. 5. The stop structure may take various forms such as pin 60 in one of the members 26, 28 which traverses curved slot 62 in the other member or a key member disposed in an arcuate keyway.

With reference to FIGS. 2–5, nose piece 28 is of generally conical configuration and has axis 53. Nose piece 28 carries ribs 70 that are aligned substantially parallel to nose piece axis 53 and offset 15° from the swash axis 52 of nose piece shank 56 and positioned such that ribs 70 are aligned with and substantially parallel to the axis 54 of the tool in the straight ahead mole position illustrated in FIG. 4 (with limit pin 60 abutting rotational stop 61). In that position, nose tip 72 lies on tool axis 54 and upper and lower soil engaging surfaces 74, 76 are disposed at equal and opposite angles to tool axis 54. In this symmetrical configuration, nose piece axis 53 is coincident with tool axis 54 and the entire tool 20 will pierce through the soil under the propulsion of impactor 23 along a straight path without the need for continuous rotation of mole 20.

Figure 5:
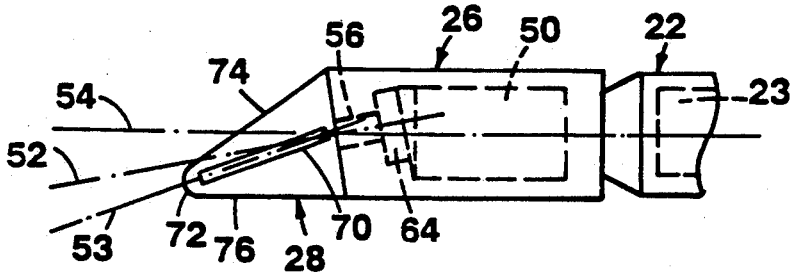
FIG. 5 is a side view of the boring head of FIG. 2 in a second position.

When base portion 26 is rotated 180° about tool axis 54 (without rotation of nose piece 28), the angular orientation of nose piece 28 is shifted to the asymmetrical position shown in FIG. 5 so that the angle between the nose piece axis 53 and tool axis 54 becomes equal to twice the difference between the tool and swash axes 52, 54. In this position (shown in FIG. 5), pin 60 abuts rotational stop 63 (as nose piece 28 does not in the soil) and the steerable head 28 is in asymmetric configuration (that is, tip 72 is offset from tool axis 54, surface 76 is parallel to axis 54, ribs 70 and noise piece axis 53 are at 30° (twice the swash angle) to tool axis 54, and surface 74 is at a still greater angle to tool axis 54). Tool 20 will move through the soil 12 along a curved path as the tool is propelled by impactor 23 without rotation.

In operation, nose piece 28 is shifted between straight position and steered position by torsional force applied to base 26 through air hose 30 and body 22. After the pin 60 or key has reached its rotational stop, a reduced level of torsional force is continued to be applied to maintain the nose piece 28 in its desired (symmetrical or asymmetrical) configuration.

The sonde 50 is located at the front end of the mole so that the tracker operator 82 can follow the mole 20. Depending on particular applications, a standard nondirectional sonde can be located in the head 24 of the guided mole 20 and a second directional sonde 78 (FIG. 1) can be located at the body 22 of the mole 20 in or near the connection of air hose 30 to the mole. The second sonde 78 transmits roll angle data, although it could also be interrogated for location and depth or desired height.

Preferably, the roll signal is transmitted, for example along the air hose 30 to be displayed in the area of the launch pit 14 or at the torque controller 32 where the mole operator 80 is generally located. The roll data provides to the mole operator an immediate indication of that aspect of the mole's progress and allows the tracker operator 82 to concentrate on monitoring position and depth of the mole 20 by sensing sonde 50. When a steering correction is called for by the tracker operator 82, the mole operator 80 will know the existing roll angle of the mole 20 and can rotate the mole 20 to shift nose 28 to the desired angular position to switch steering modes as desired.

Figure 6:
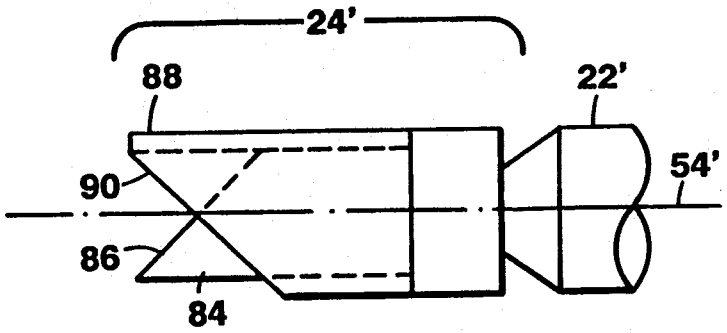
FIG. 6 is a side view of a second boring head embodiment.
Figure 7:
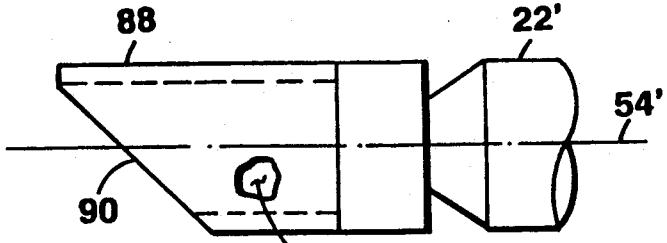
FIG. 7 is a side view of the embodiment of FIG. 6 in a second position.

Another steerable head embodiment 24' is illustrated in FIGS. 6 and 7 and includes central core member 84 with slant face 86 (disposed at an angle of 45° to axis 54')

and outer sleeve 88 with slant face 90 (also disposed at 45° to axis 54' but of opposite orientation from face 86). Sleeve 88 is rotatable relative to core 84 in manner similar to rotation of nose piece 28 relative to base 26 between a symmetrical position shown in FIG. 6 and a steered mode position shown in FIG. 7 in which slant faces 86, 90 are in alignment.

As in the embodiments shown in FIGS. 1–5, when straight ahead moling is desired, the mole body 22' and core 84 are rotated clockwise as a unit relative to sleeve 88 (which is engaged with the soil 12) by applying clockwise torsional movement to the air hose 30'. When the rotational stop is reached, the head configuration will be that of the slant faces 86 and 90 at equal and opposite slant angles (FIG. 6) such that the steering effect of those two slant faces will oppose and cancel each other and the mole 20' will advance straight ahead as long as sufficient torque is applied to keep the sleeve 88 and central core 84 against their stops. To balance the opposed steering forces, the frontal areas of the slant faces 86 and 90 are proportioned appropriately. For example, the axis of the sleeve 88 may be offset from the rotational axis 54' of the mole, or the tip of the outer sleeve 88 may be blunted or otherwise modified. Switchover to the steered mode is accomplished by applying torsional force in the opposite direction to rotate the core 84 relative to the sleeve 88 to the position shown in FIG. 7 in which slant faces 86, 90 are aligned in asymmetrical configuration. Ribs can be employed on sleeve 88 to facilitate switch over between straight and curved travel modes.

Figure 8:
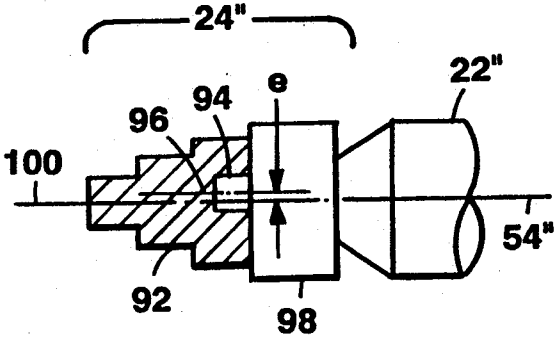
FIG. 8 is a side diagrammatic and partial sectional view of another embodiment of a boring head for use in the system shown in FIG. 1.
Figure 9:
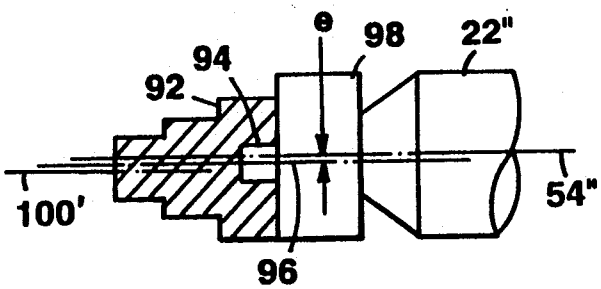
FIG. 9 is a view, similar to FIG. 8, showing that embodiment in a second position.

In another embodiment (shown in FIGS. 8 and 9), nose element 92 (which may be conical, cylindrical, or stepped as shown), is mounted on stub shaft 94 that has rotational axis 96 that is offset from mole axis 54''. As in the embodiments shown in FIGS. 1–7, when straight ahead moling is desired, the mole body 22'' and base 98 are rotated as a unit relative to nose member 92 (which is engaged with the soil 12) by applying torsional moment to air hose 30''. When the rotational stop is reached, the head configuration will be that of FIG. 8 (with nose axis 100 coincident with tool axis 54'') such that the mole 20'' will advance straight ahead as long as sufficient torque is applied to keep the base 98 and nose 92 against their stops. Switchover to the steered mode is accomplished by applying torsional force in the opposite direction to rotate the base 98 relative to nose 92 to the position shown in FIG. 9 in which nose axis 100 is parallel to and offset from tool axis 54'' and nose 92 is in asymmetrical configuration relative to body 94 and tool axis 54''. Ribs can be employed on nose 92 to facilitate switch over between straight and curved travel modes.

While particular embodiments of the invention have been shown and described, other embodiments will be apparent to those skilled in the art, and therefore, it is not intended that the invention be limited to the disclosed embodiments, or to details thereof, and departures may be made therefrom within the spirit and scope of the invention.

What is claimed is:

1. Moling apparatus for forming a generally horizontal underground passage in soil for a utility conduit or the like comprising tool head structure that defines a tool axis, said tool head structure including a base portion and a nose portion mounted on said base portion, impact structure for applying a series of percussive impacts to said tool head structure for driving said tool head structure through the earth by displacing soil without necessity of soil removal, said nose portion being rotatable relative to said base portion between a first position in which said nose portion has surfaces which are in symmetrical position with respect to said tool axis and a second position in which said nose surfaces are in asymmetrical position with respect to said tool axis so that said tool will move through the soil along a straight path when said nose portion is in said first position and will move through the soil along a curved path when said nose portion is in said second position in response to impact forces generated by said impact structure, and structure for applying torsional force to said base portion to rotate said base portion about said tool axis relative to said nose portion selectively to shift said nose portion between said first and second positions.

2. The apparatus of claim 1 wherein said nose portion is mounted on said base portion for rotation about a swash axis that is at an angle to said tool axis.

3. The apparatus of claim 1 wherein said nose portion includes a sleeve member with a cylindrical inner surface, said base portion includes a core member with a cylindrical outer surface and is disposed within said sleeve member, and said sleeve and core members have face portions that are in offset orientation in said first position and in aligned relation in said second position.

4. The apparatus of claim 1 wherein said nose portion is mounted on said base portion for rotation about an axis that is parallel to and offset from said tool axis.

5. The apparatus of claim 1 wherein said torsional force applying structure includes elongated torsionally stiff structure connected to said tool head structure and adapted to extend to the surface of the soil in which said passage is to be formed.

6. The apparatus of claim 5 wherein said impact structure is pneumatically actuated, and said torsionally stiff structure is an air hose for supplying pressurized air to said impact structure.

7. The apparatus of claim 6 and further including operator controllable torque generating structure for applying torsional force to said air hose at the surface of the soil in which said passage is to be formed.

8. The apparatus of claim 1 and further including sonde structure in said tool head structure for supplying positional information to a point above the surface of the soil in which said passage is to be formed.

9. The apparatus of claim 8 wherein said torsional force applying structure includes elongated torsionally stiff structure connected to said tool head structure and adapted to extend to the surface of the soil in which said passage is to be formed.

10. The apparatus of claim 9 wherein said impact structure is pneumatically actuated, and said torsionally stiff structure is an air hose for supplying pressurized air to said impact structure.

11. The apparatus of claim 10 and further including operator controllable torque generating structure for applying torsional force to said air hose at the surface of the soil in which said passage is to be formed.

12. The apparatus of claim 11 wherein said nose portion is mounted on said base portion for rotation about a swash axis that is at an angle to said tool axis.

13. The apparatus of claim 11 wherein said nose portion includes a sleeve member with a cylindrical inner surface, said base portion includes a core member with a cylindrical outer surface and is disposed within said sleeve member, and said sleeve and core members have face portions that are in offset orientation in said first position and in aligned relation in said second position.

14. The apparatus of claim 11 wherein said nose portion is mounted on said base portion for rotation about an axis that is parallel to and offset from said tool axis.

15. Moling apparatus for forming a generally horizontal underground passage in soil for a utility conduit or the like comprising tool head structure that defines a tool axis, said tool head structure including a base portion and a nose portion mounted on said base portion, said nose portion being rotatable relative to said base portion between a first position in which said nose portion has surfaces that are symmetrical with respect to said tool axis and a second position in which said nose surfaces are in asymmetrical position with respect to said tool axis so that said tool will move through the soil along a straight path when said nose portion is in said first position and will move through the soil along a curved path when said nose portion is in said second position.

16. The apparatus of claim 15 wherein said nose portion is mounted on said base portion for rotation about a swash axis that is at an angle to said tool axis.

17. The apparatus of claim 15 wherein said nose portion includes a sleeve member with a cylindrical inner surface, said base portion includes a core member with a cylindrical outer surface and is disposed within said sleeve member, and said sleeve and core members have face portions that are in offset orientation in said first position and in aligned relation in said second position.

18. The apparatus of claim 17 wherein said face portions include planar surfaces disposed at slant angles to said tool axis.

19. The apparatus of claim 15 wherein said nose portion is mounted on said base portion for rotation about an axis that is parallel to and offset from said tool axis.

20. The apparatus of claim 15 and further including sonde structure in said tool head structure for supplying positional information to a point above the surface of the soil in which said passage is to be formed.

* * * * *

UNITED STATES PATENT AND TRADEMARK OFFICE

CERTIFICATE OF CORRECTION

PATENT NO. : 5,322,391

DATED : June 21, 1994

INVENTOR(S) : Allan T. Fisk

It is certified that error appears in the above-identified patent and that said Letters Patent is hereby corrected as shown below:

On the title page:
In the references cited section, please add the following U.S. Patent Documents:

| | | |
|---|---|---|
| "4,953,638 | 09/1990 | Dunn |
| 4,907,658 | 03/1990 | Stangl et al. |
| 3,525,405 | 06/1968 | Coyne et al." |

Col. 3, line 13, after "pushers" insert a period.

Col. 4, line 29, after "not" insert --rotate--.

Signed and Sealed this

Fourth Day of October, 1994

*Attest:*

*Attesting Officer*

Bruce Lehman

BRUCE LEHMAN

*Commissioner of Patents and Trademarks*